US005516207A

United States Patent [19]

Habicht

[11] Patent Number: 5,516,207

[45] Date of Patent: May 14, 1996

[54] METHOD FOR BLENDING DRY FLOWABLE MATERIALS

[76] Inventor: Helmüt Habicht, 15 Royal Park Ter., Hillsdale, N.J. 07642

[21] Appl. No.: 532,425

[22] Filed: Sep. 22, 1995

[51] Int. Cl.[6] ..... B01F 9/02

[52] U.S. Cl. ..... 366/213; 366/228; 366/236

[58] Field of Search ..... 366/26, 53–58, 366/62, 63, 189, 192, 197, 208, 209, 212, 213, 218,219, 220, 225, 228, 229, 236, 348; 248/130

[56] References Cited

U.S. PATENT DOCUMENTS

| | | | |
|---|---|---|---|
| 3,174,728 | 3/1965 | Mack | 366/213 |
| 4,077,613 | 3/1978 | Wilson | 366/213 |
| 4,100,616 | 7/1978 | Wilson | 366/236 X |
| 4,372,686 | 2/1983 | Herfeld | 366/235 X |
| 4,775,242 | 10/1988 | Bohle | 366/209 |
| 4,957,373 | 9/1990 | Derksen et al. | 366/197 |
| 5,344,275 | 9/1994 | Habicht | 414/420 |
| 5,388,807 | 2/1995 | Habicht | 251/306 |

*Primary Examiner*—Charles E. Cooley
*Attorney, Agent, or Firm*—Patrick J. Pinto

[57] ABSTRACT

A method for blending dry flowable materials by charging a blending container, the blending container having geometrical shaped deflector members mounted interior of its blending chamber. A crest of the deflector members being angularly positioned with respect to a rotational axis of the blending container for cross blending the flowable material. The blending container is positioned and transported to a lifting and rotating apparatus on a dolly. The lifting apparatus includes a means for securing the blending container to the lifting apparatus by pivoting its lift forks interior of a pair of support members of the blending container. The flowable material is discharged after blending by positioning and opening a port of a discharge end of the blending container over an apparatus to be charged with the blended material.

7 Claims, 5 Drawing Sheets

METHOD FOR BLENDING DRY FLOWABLE MATERIALS

BACKGROUND OF THE INVENTION

1. Field of the Invention

With regard to the classification of art, this invention is believed to be found in the general class entitled Agitating and more particularly to those subclasses pertaining to methods for using mixing chambers that rotate relative to a support.

2. Description of Related Art

Vee-type and conical-type blenders are known in the prior art. Each of these types of blenders utilizes a blending chamber that is rotated about an axis. The vee-blender is made of two cylindrical chambers that are abutted and joined in the form of a "V". The mixing or blending occurs as the material flows into and away from the common joint during rotation. The conical blender is generally comprised of two cones that are joined at their largest diameter. Mixing or blending of materials occurs, in this type of apparatus, as the material alternately flows from one cone to the other during rotation.

The above mentioned type of blenders are commercially available. However most of the known blenders are very large and therefore require that the mixing or blending chambers be more or less permanently mounted on the rotating axis. This type of arrangement also requires that the chambers be completely cleaned between the blending of dissimilar batches of product. U.S. Pat. No. 4,775,242, that issued to Bohle on Oct. 04, 1988, discloses a mixing apparatus that uses interchangeable blending containers. The apparatus disclosed in this patent requires manual intervention. That manual intervention may include the following: A) the containers must be manually secured to the lifting apparatus; and B) the mixing elements must be manually removed during the charging process then reinserted for mixing.

There has been determined that there is a need for a blending method that would increase the productivity of the process line. The needed blending equipment should have easily removable and interchangeable blending chambers and be adapted for automatic operation with a minimum of manual intervention. It is also desirable that the support portion of the blending apparatus be adaptable for use in other production operations. It is also a requirement that the interchangeable chambers be easily charged and provide a substantially homogeneous mix. A homogeneous mix is attained by the efficient cross blending of the material. It is also desired that the equipment provide other functions such as automatic discharge into supply reservoirs of pill molding machinery. The needed method should also be adaptable for the movement of the blending container from a loading position to at least one subsequent discharge position. The present invention provides a method for solving the above identified needs.

SUMMARY OF THE INVENTION

The present invention may be briefly described as: a method of blending batches of flowable product comprising the steps of:

a) charging a transportable blending container with a flowable product; the blending container includes, a blending chamber portion, at least two elongated geometrical shaped deflector members, a pair of elongated support rails, a hopper portion; and a valve means, the two elongated geometrical shaped deflector members are mounted interior of the mixing chamber in opposed relationship, the pair of elongated support rails are selectively positioned with respect to the elongated geometrical shaped deflector members, the valve means is arrayed for controlling the flow of the flowable product through an opening in the hopper portion;

b) transporting the blending container to a blending location on a detachable dolly, c) aligning the pair of elongated support rails with a pair of lift forks of a lifting apparatus, each of the lift forks being configured for mating with its associated support rail;

d) inserting the pair of lift forks into the pair of support rails to a selected position;

e) securing the lift forks to the support rails by rotating at least one of the lift forks interior of the support rails;

f) lifting the blending container from the detachable dolly by raising the forks along a column of the lifting apparatus;

g) blending the flowable material in the blending container by rotating the lifted container about a horizontal mounting axis of the lift forks;

h) moving the blending container from a loading position to at least one subsequent position for discharging the blending container by pivoting the lifting apparatus about a vertical axis of the column;

i) moving the blending container to a disengaging position;

j) lowering the blending container onto the dolly;

k) loosening the lift forks with respect to the support rails by rotating at least one of the lift forks interior of the support rails; and l) removing the blending container from said lift forks by transporting the blending container on the dolly.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode for a blending method of the present invention. These specific embodiments, as shown in the accompanying drawings, may also include diagrammatic symbols for the purpose of illustration and understanding.

Figure 3:
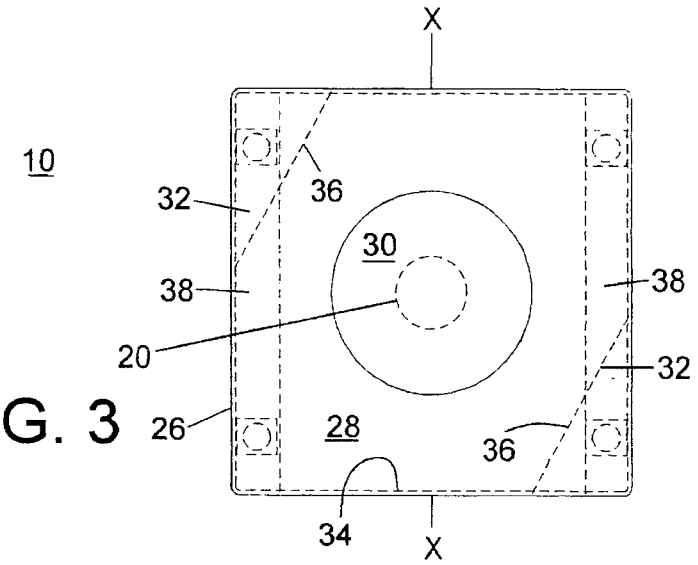
FIG. 3 represents a top elevation of the blending container assembly.

In the following description and in the appended claims, various details are identified by specific names for convenience. These names are intended to be generic in their application while differentiating between the various details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Figure 2:
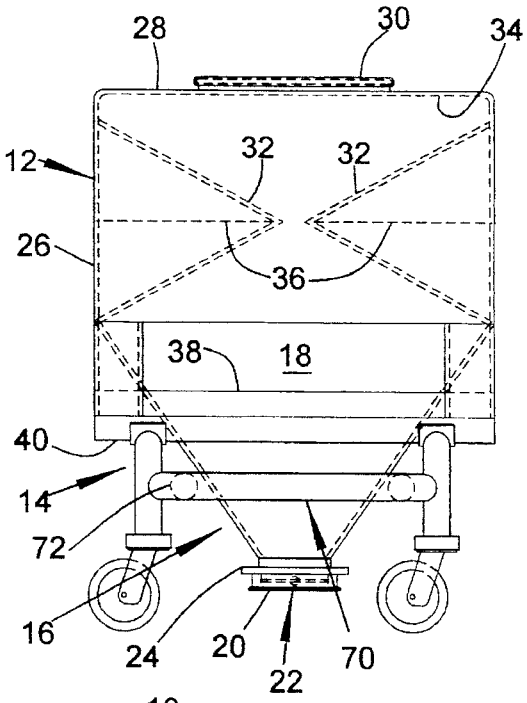
FIG. 2 represents a side elevation of the blending container assembly.
Figure 1:
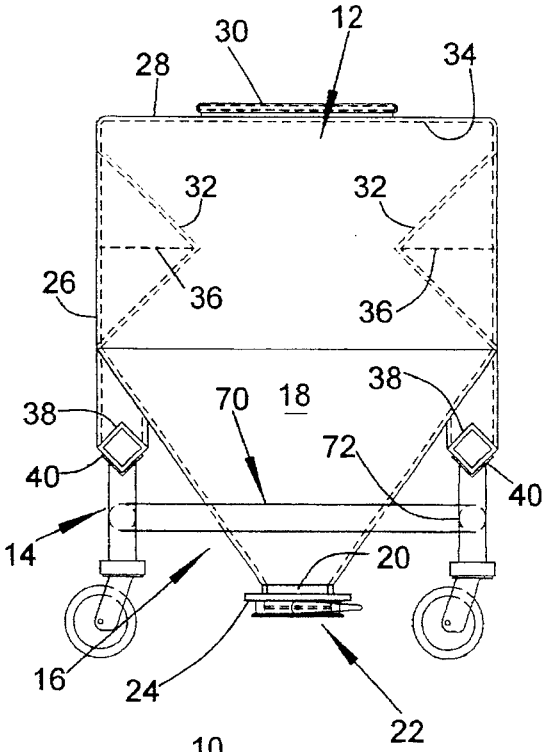
FIG. 1 represents a front elevation of a blending container assembly used in the present invention.

FIGS. 1, 2 and 3 represent one type of a transportable blending container assembly, that is generally identified as 10. This blender container assembly 10 includes a closable blending container 12 and a dolly 14. The blending container 12 includes a discharge end 16. Preferably the discharge end 16 has a hopper portion 18 that terminates at an aperture 20. The aperture 20 should include a closing means 22 such as a valve or a removable cover. It is preferred that the closure means 22 be a butterfly valve such as that shown in U.S. Pat. No. 5,388,807. U.S. Pat. No. 5,388,807 issued to and is solely owned by the present inventor and is incorporated into this application by reference to the extent allowable by present law. The valve means 22 may be powered or manually operated. It is preferred that the closure means include a quick disconnect coupling 24 that is also disclosed in that subject U.S. patent.

Figure 5:
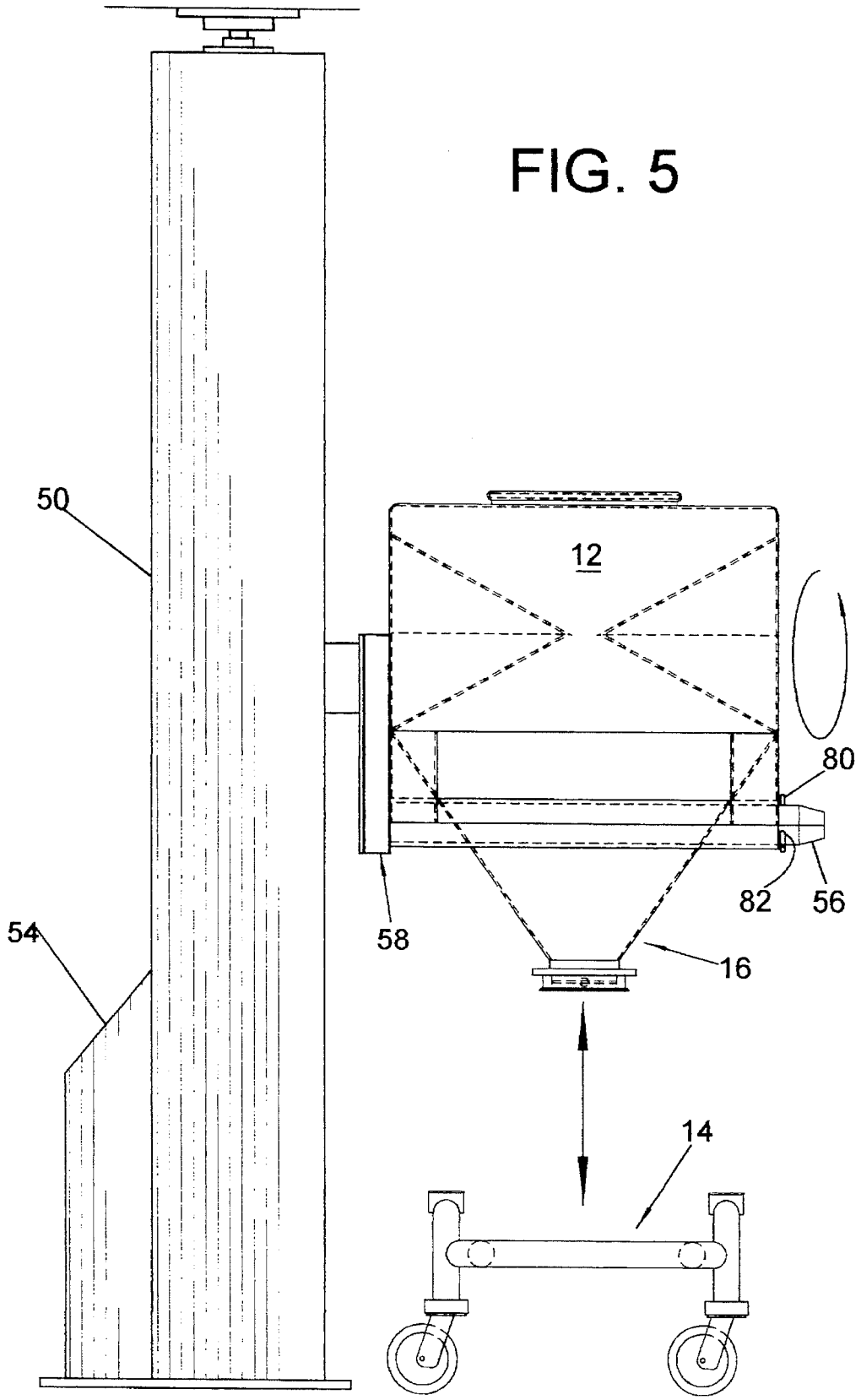
FIG. 5 represents a side elevation of the blending container after separation from a transportation dolly by a support structure.

The blending container 12 preferably has a rectangular body portion 26 and a top portion 28. The rectangular body is preferred because its capacity is maximized for the space used. The top portion 28 may include a removable cover 30 that may be used for filling the blending container 12 when it is positioned on the dolly 14. It is to be noted that the blending container 12 may be filled through aperture 20 if and when the blending container is in an inverted condition. A pair of geometrical shaped deflector members 32 are mounted in a blending chamber 34 of the blending container 12. It is preferred that the deflector members 32 be substantially alike. It is also preferred that the deflector members 32 be arrayed so that each crest portion 36 have a slope or angular relationship with respect to its horizontal axis of rotation X—X, when viewed from the top of the blending container. The length of the deflectors 32 should be at least one-third of the length of a side of the blending container 12. The maximum height of the deflectors 32 should be at least one-quarter of the length of its abutting side. It is preferred that the deflectors 32 have an isosceles triangular cross-section. It is also preferred that the included angle at the crest portion 36 be at least equal to twice the Angle of Repose of the materials to be blended. It is anticipated that the deflectors 32 may have other cross-sections such as an arc, S-curve or the like, It has been found that the sloped deflectors 32 provide a cross blending action of the materials as and when the blending container is rotated about its horizontal axis X—X, as seen in FIG. 5.

Referring again to FIGS. 1, 2 and 3, the blending container 12 includes a pair of elongated support rails 38 that are firmly attached thereto. It is preferred that each of the elongated support rails 38 have a square cross-section. It is anticipated that elliptical or other polygon cross sections may be used. It is also preferred that each of the square support rails 38 be arrayed so that their sides are at forty-five degrees to the horizontal, as more clearly seen in FIG. 1. Referring still to FIG. 1, arraying the elongated rails 38 in this manner allows their nesting into mating V-shaped members 40 of the dolly 14.

Figure 4:
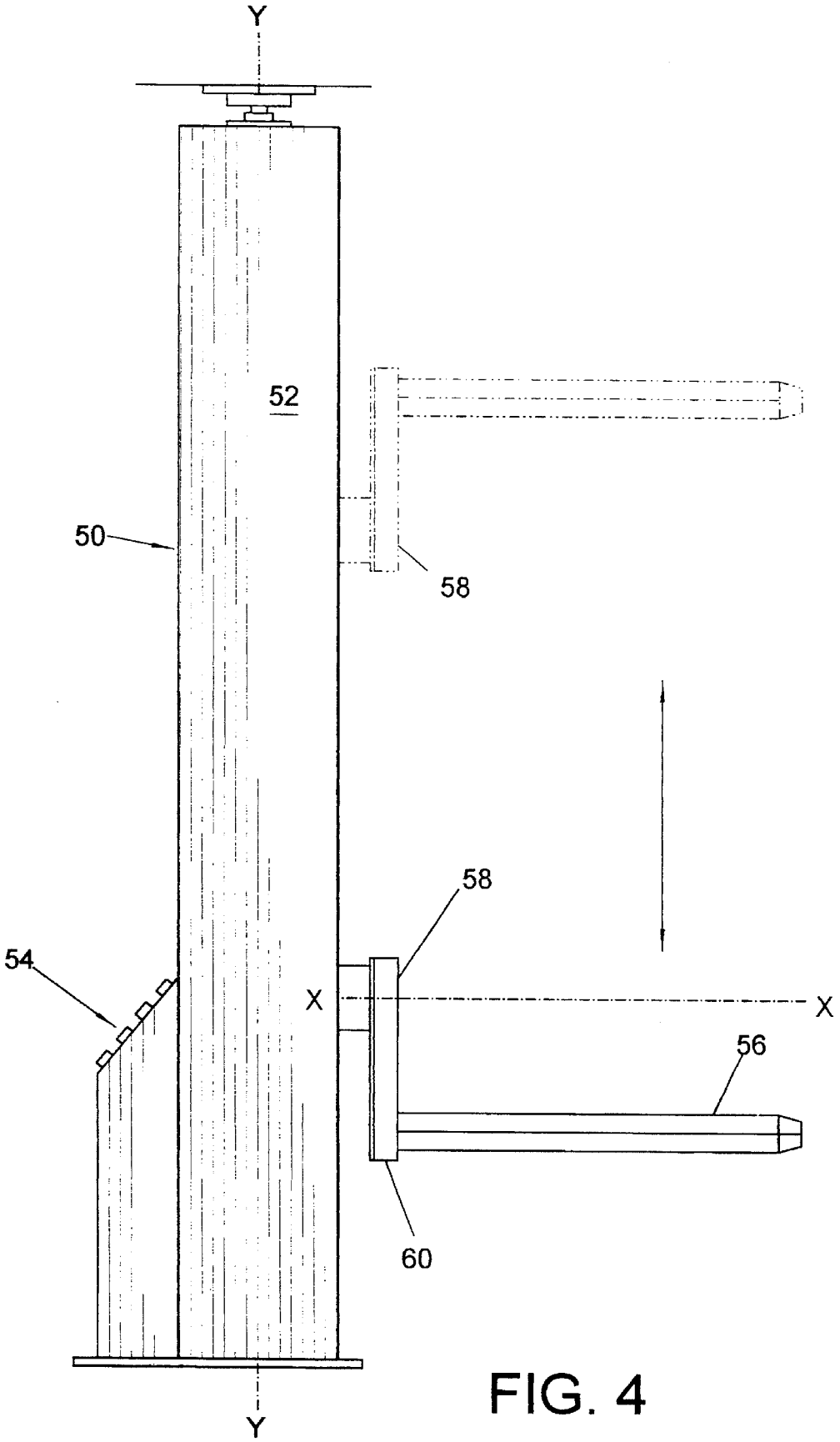
FIG. 4 represents a side elevation of one type of support structure that may be used in the present invention.
Figure 7:
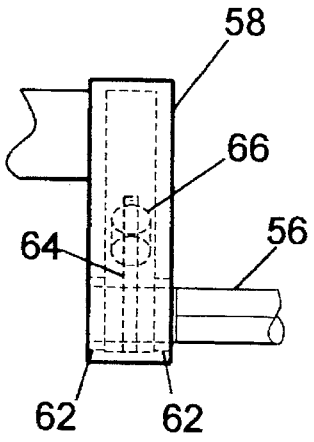
FIG. 7 represents a side elevation of the mechanism of FIG. 6.
Figure 6:
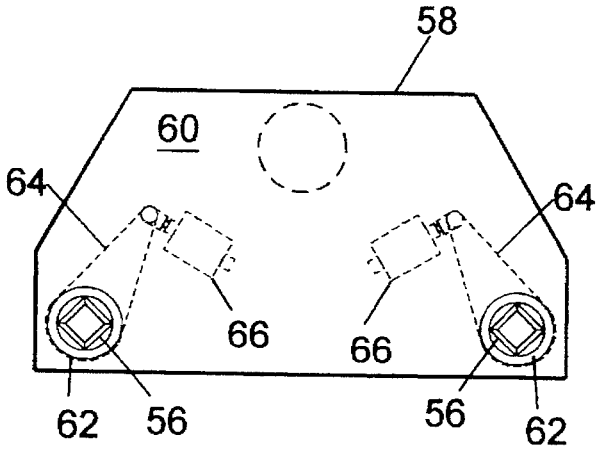
FIG. 6 represents a front elevation, in an enlarged scale, of a mechanism for securing the blending container on a fork portion of the support structure.

Referring now to FIGS. 4, 6 and 7, the blending container 12 is intended to be used with a lifting apparatus that is generally identified as 50. Generally the lifting apparatus 50 includes a column member 52, a control panel 54, and a pair of lifting forks 56 of a container support 58. The container support 58 is rotatably carried by a carriage member, that is not seen. The carriage member is enclosed within the column 52. One example of a lifting apparatus assembly is shown in U.S. Pat. No. 5,344,275, that has been issued to the present inventor. U.S. Pat. No. 5,344,275 is solely owned by the present inventor and is incorporated by reference into the present invention to the extent the present law allows. However, it is to be understood that the lifting apparatus is not limited to the type disclosed in U.S. Pat. No. 5,344,275. The lifting apparatus 50 may be of the fixed column type. This means that at least one end of the column 52 is secured to a support structure, such as a floor. Alternatively the column 52 may be pivotally attached to a support structure.

Referring in particular to FIG. 6 and 7, the pair of lifting forks 56 are pivotally carded by the container support member 58. The present invention is intended for use in a pharmaceutical process plant, therefore all of the exposed surfaces must be smooth for easy cleaning and sanitizing. One typical arrangement for the pivotal mounting of each of the lifting forks 56 to the housing 60 includes: a pair of sealed bearings 62, a lever member 64, and an actuator 66. The housing 60 should have a sealable access panel for assembly and service. The actuator 66, such as a pneumatic or electric linear actuator, causes the lifting fork 56 to rotate between ten and twenty degrees in its bearings 62. Each actuator 66 may be selectively controlled by an operator from the control panel 54. Alternatively the securing operation may be automatically controlled in response to the presence of a properly aligned and located blending container. The present method allows for adaptation to a fully automated process line by incorporating a computerized control system that is responsive to automated sensing means, such as limit switches, proximity switches and the like.

Referring again to FIGS. 1 and 2, the dolly 14 includes a frame 70 that is carded on wheels or casters. Preferably, the frame 70 is arrayed for guiding the blending container 12 to a proper transporting position. A pair of cross-members 72 of the frame are selectively spaced for guiding the inclined sides of the hopper 16 to a seated condition. The V-shaped members 40 provide guidance for the blending container 12 in a direction that is at ninety degrees to the cross members 72. The combination of the cross members 72 and the V-shaped members limit the lateral movement of the seated blending container 12 with respect to the dolly 14. The dolly may be manually moved from one place to another. Alternatively the dolly may be moved by a guided locomotive means such as a robot or the like.

Figure 9:
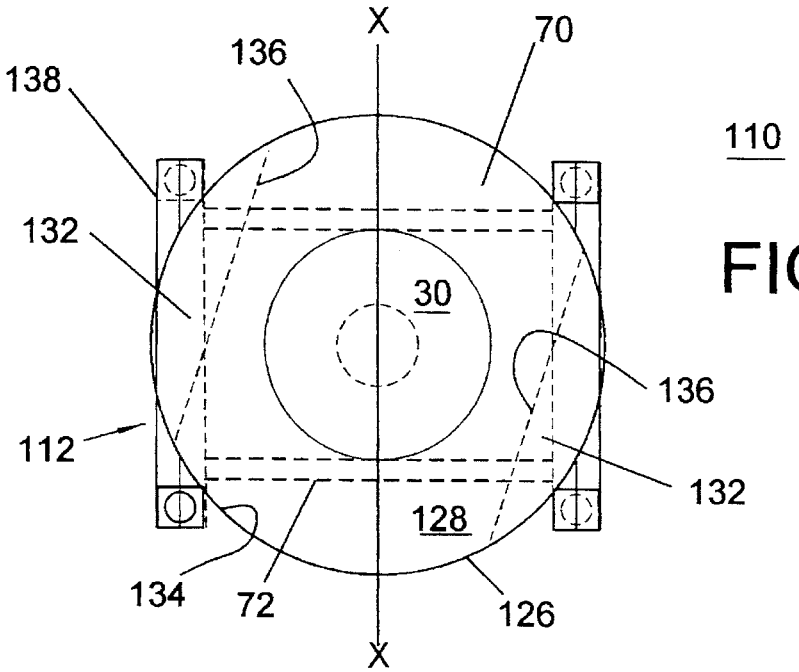
FIG. 9 represents a top view of the alternate embodiment of FIG. 8.
Figure 8:
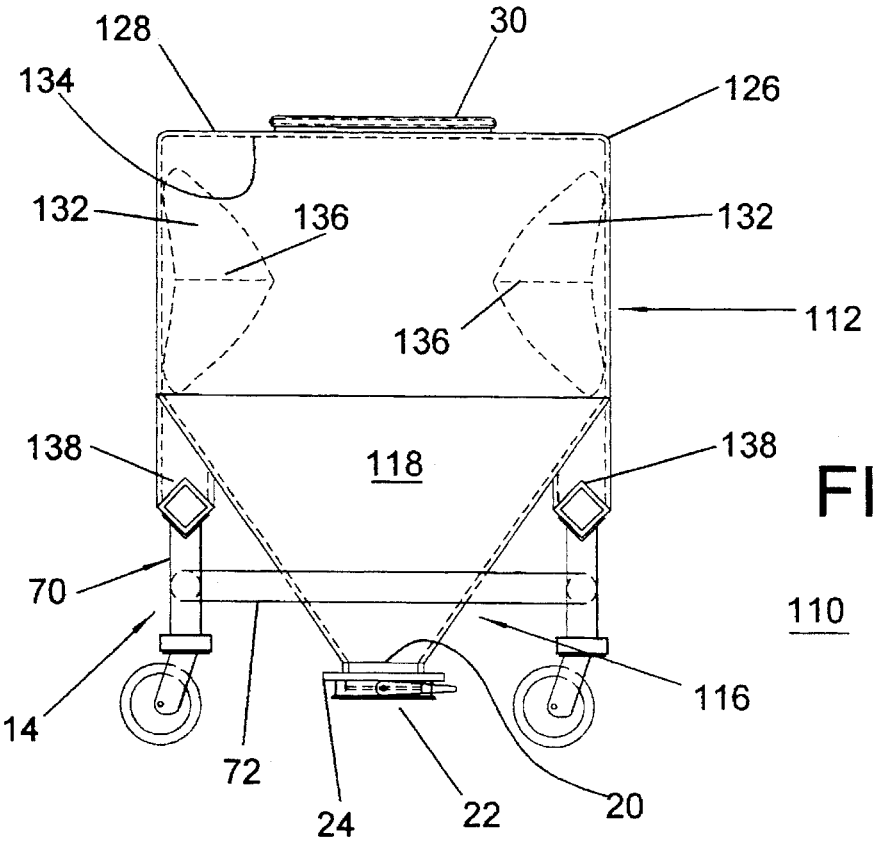
FIG. 8 represents a front elevation view, of an alternate embodiment of a transportable blending container assembly

Referring now to FIGS. 8 and 9, an alternate embodiment for a blending container assembly is generally identified as 110. This blender container assembly 110 includes a closable blending container 112 and a dolly 14. The dolly is similar to the dolly that has been described above. The blending container 112 includes a discharge end 116. Preferably the discharge end 116 has a hopper portion 118 that terminates at an aperture 20. The aperture 20 should include a closing means 22 such as a valve or a removable cover. It is preferred that the closure means 22 be a butterfly valve. A typical valve and connection means have been discussed above.

The alternative blending container 112 has a cylindrical body portion 126 and a top portion 128. The top portion 128 may include a removable cover 30 that may be used for filling the blending container 112 when it is positioned on the dolly 14. It is to be noted that the blending container 112 may be filled through aperture 20 if and when the blending container is in an inverted condition. A pair of geometrical shaped deflector members 132 are mounted in a blending chamber 134 of the blending container 112 in an opposed relationship. It is preferred that the deflector members 132 be substantially alike. It is also preferred that the deflector members 132 be arrayed so that each crest portion 136 have an angular chord-like relationship with respect to its horizontal axis of rotation X—X, when viewed from the top. It is preferred that the deflectors 132 have an isosceles triangular cross-section. It is also preferred that the included angle at the crest portion be at least equal to twice the Angle of Repose of the materials to be blended. As in the case of blending container assembly 12, the deflectors 132 may have other cross-sections such as an arc, S-curve or the like. It has been found that the sloped deflectors 32 provide a cross blending action of the materials as and when the blending container is rotated about its horizontal axis X—X.

The blending container 112 includes a pair of elongated support rails 138 that are firmly attached thereto. The support rails 138 are similar to support rails 38 that have been previously discussed.

USE AND OPERATION

A blending container 12 or 112 is charged with flowable materials to be blended. The filled blending container 12 or 112 is transported to a blending station on the dolly 14. The dolly 14 may be manually or automatically moved from one site to another. The assembly 10 or 110 is positioned so that the lifting forks 56 of a lifting apparatus 50 are inserted into the mating support rails 38 or 138 of the blending container 12 or 112, as seen in FIG. 5.

The lifting fork 56 is rotated by its actuator 66 so that an interference fit exits between at least one of the lift forks 56 and one of the support rails 38 or 138. Optionally, a pin 80 may be inserted into an aperture 82 at the end of each lift fork 56, as an extra safety means. The pin 80 may be seen in FIG. 5.

The blending container may be lifted by the lift apparatus 50, after a determination has been made that the blending container 12 or 112 is secured to the lift forks 56. This determination may be made by a sensing means such as a limit switch, proximity switch or the like.

The blending container is rotated a predetermined number of revolutions by the lifting apparatus 50 about its axis X—X. The angled deflectors 32 and 132 cause the flowable materials to cross blend during rotation. The lifting apparatus 50 may be pivoted about its axis Y—Y for moving the blending container to a new location for discharge. This discharge may take place over and onto a feeding end of a machine for molding tablets, pills and the like.

After the blending container is fully discharged, it may be returned to the loading station or to a third location for removal from the lifting apparatus 50. Of course a dolly should be in position for accepting the discharged container. The lift forks 56 are counter-rotated to an unsecured condition by the actuators 66 and then any pins 80 may be removed. At this time the blending container may be transported away from the lifting apparatus.

Directional terms such as "front", "back", "in", "out", downward, upper, lower and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A method of blending batches of flowable product comprising the steps of:

a) charging a transportable blending container with a flowable product; the blending container includes at least two opposing elongated triangular shaped deflector members, a pair of elongated support rails, a blending chamber, a hopper portion in communication with said blending chamber; and a valve means, the elongated triangular shaped deflector members being attached to opposing interior walls of the blending chamber; the pair of elongated support rails being selectively positioned with respect to the elongated triangular shaped deflector members, the valve means for controlling the flow of the flowable product through an opening in the hopper portion;

b) moving the transportable blending container to a blending location on a detachable dolly, rail;

c) aligning the pair of elongated support rails with a pair of lift forks of a lifting apparatus, each of the lift forks being configured for mating with its associated support d) inserting the pair of lift forks into the pair of support rails to a selected position;

e) securing the lift forks to the support rails by rotating at least one of the lift forks interior of the support rails;

f) lifting the blending container from the detachable dolly by raising the lift forks along an axis of a column of the lifting apparatus;

g) blending the flowable product in the blending container by rotating the lifted container about a horizontal mounting axis of the lift forks;

h) lowering the blending container onto the dolly;

i) loosening the lift forks with respect to the support rails by counter-rotating each of the lift forks that were securing the lift forks to the interior of the support rails; and j) removing the blending container from said lift forks by moving the dolly.

2. The method as recited in claim 1 which includes the further step of discharging the flowable product from the blending container after the blending of the flowable product by selectively opening the valve means.

3. The method as recited in claim 2 further includes the step of retaining the blending container on the lift forks by inserting a safety pin into mating apertures of the lift forks, the mating apertures being transverse to the axis of the lift forks.

4. The method as recited in claim 1 which includes the further step of causing the flowable product to cross blend by arraying the opposing elongated triangularly shaped deflector members so that the height of the triangular shape decreases uniformly from a selected maximum height to a minimum height for a selected length and the selected maximum height of each deflector being positioned at diagonally opposing corners of the blending container.

5. The method as recited in claim 4 which includes the further step of discharging the flowable product from the blending container after the blending of the flowable product by selectively opening the valve means.

6. The method as recited in claim 4 further includes the step of retaining the blending container on the lift forks by inserting a safety pin into mating apertures of the lift forks, the mating apertures being transverse to the axis of the lift forks.

7. The method as recited in claim 1 further includes the step of retaining the blending container on the lift forks by inserting a safety pin into mating apertures of the lift forks, the mating apertures being transverse to the axis of the lift forks.

* * * * *